United States Patent [19]

Huff et al.

[11] 4,249,047

[45] Feb. 3, 1981

[54] GAS VALVE-SWITCH ASSEMBLY

[75] Inventors: Norman M. Huff, Chicago; George T. Horodeck, Princeton, both of Ill.

[73] Assignee: Harper-Wyman Company, Hinsdale, Ill.

[21] Appl. No.: 933,174

[22] Filed: Aug. 14, 1978

[51] Int. Cl.[3] ..... H01H 9/06

[52] U.S. Cl. ..... 200/61.86; 200/293; 431/256

[58] Field of Search ..... 200/61.86, 293, 294; 431/256, 257

[56] References Cited

U.S. PATENT DOCUMENTS

| | | | |
|---|---|---|---|
| 1,904,061 | 4/1933 | Larson | 251/89.5 |
| 2,276,751 | 3/1942 | Weber | 431/256 |
| 2,327,951 | 8/1943 | Zaleske | 403/289 |
| 2,961,000 | 11/1960 | Remus et al. | 137/599.2 |
| 3,300,233 | 1/1967 | Olson | 280/453 |
| 3,405,869 | 10/1968 | Grayson et al. | 236/15 |
| 3,436,165 | 4/1969 | Gehrke | 431/256 |
| 3,502,835 | 3/1970 | Batcheller | 200/154 |
| 3,885,851 | 5/1975 | Bennett | 339/91 R |
| 3,971,904 | 7/1976 | Ward | 200/6 BB |
| 4,002,872 | 1/1977 | Deslo | 200/294 |

FOREIGN PATENT DOCUMENTS

| | | | |
|---|---|---|---|
| 1250979 | 10/1971 | United Kingdom | 200/61.86 |

*Primary Examiner*—J. V. Truhe
*Assistant Examiner*—Morris Ginsburg
*Attorney, Agent, or Firm*—Mason, Kolehmainen, Rathburn & Wyss

[57] ABSTRACT

A detachable gas valve—switch assembly intended especially for a domestic gas range, in which the valve includes a body has a control element movable by a rotatable valve stem and the switch having a contact operating means rotatable by the stem. The switch is constructed and arranged for releasable retention in a position closely adjacent the front end of a gas valve. It is also apertured for mounting on the stem and for movement in one direction axially of the stem to said position and in the opposite direction for removal from said position. The switch and valve include axially extending resiliently engageable quick attach-detach coupling structure of novel construction for releasably and firmly retaining said switch axially in said position upon movement in one direction into said position, and includes also switch contact operating means engageable with said driving portion of said stem when in said position. Movement in the opposite direction disengages the switch retention and contact operating means. The coupling structure is novel in and of itself.

14 Claims, 5 Drawing Figures

Fig. 1
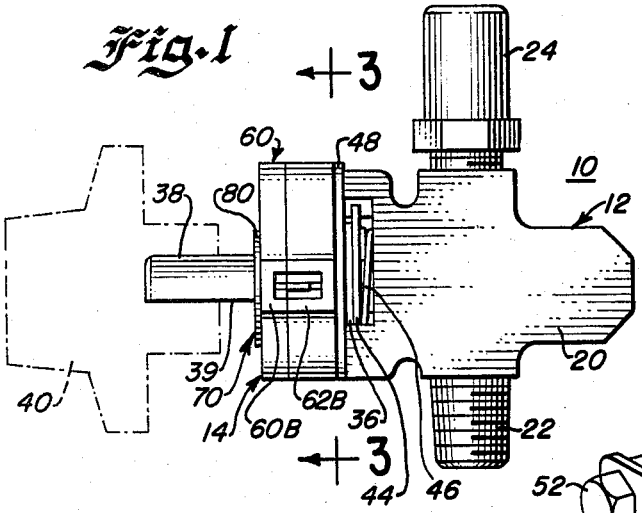
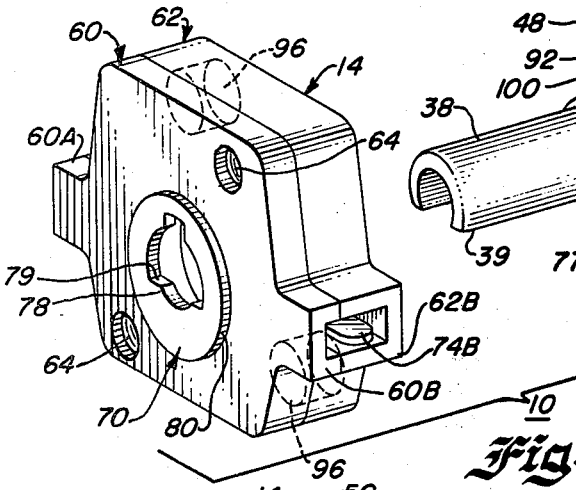
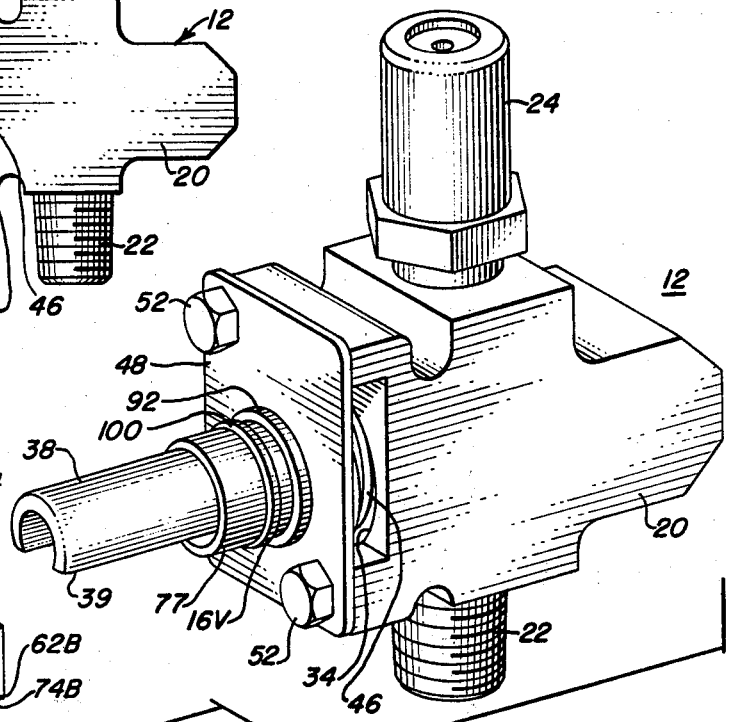
Fig. 2
Fig. 3
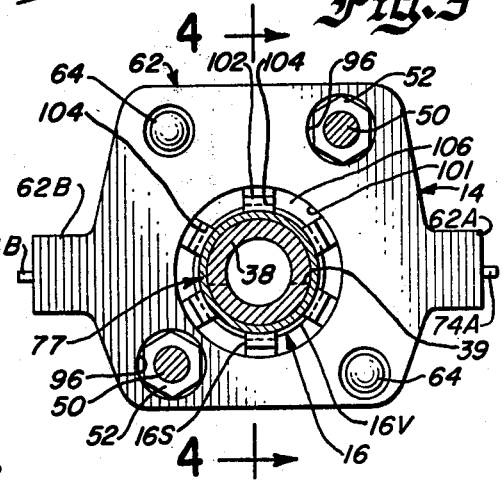
Fig. 4
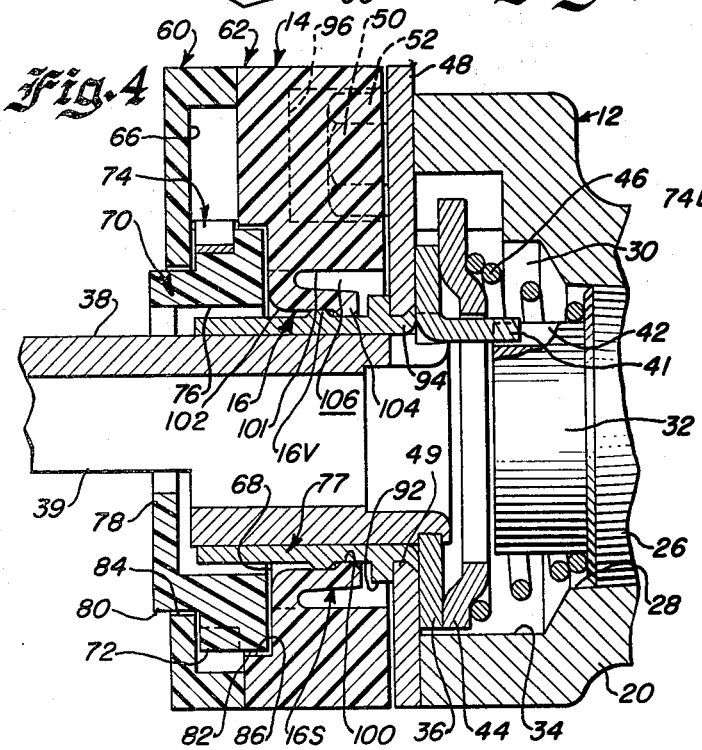
Fig. 5
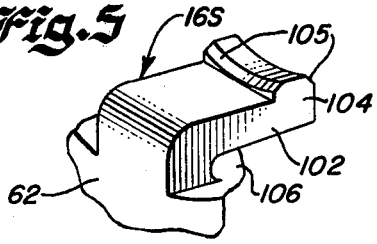

GAS VALVE-SWITCH ASSEMBLY

Electrical ignition is being increasingly used on gas appliances, notably domestic gas ranges. As a consequence, efforts have been made to construct improved combined gas valves and electric ignition switches. The valves generally are of the type utilizing rotary control elements such as plugs or discs operable by axially extending rotatable stems and the switches are of a type secured to or adjacent the valve and including contact operating cams rotatable by the stems. In most cases the switch has been secured to the valve by machine screws but efforts have been made otherwise to secure the switch relative to the valve. Also, the valve stem may be axially movable for unlocking purposes.

The present invention provides means for readily coupling and uncoupling valves and switches by axial movement and for holding them firmly in closely adjacent position when coupled and requiring firm separating force for uncoupling. A gas valve may include a conventional body and rotary plug mounted in a body opening or bore closed by a top cap secured to the body by machine screws in conventional manner. The plug may be detachably connected or coupled to an axially extending operating stem projecting through an aperture in the top cap to receive an operating handle at its outer end. In one embodiment of the invention, an outwardly projecting tubular stem bushing of some length is attached to and extends forwardly of the top cap. The stem is closely journaled in the bushing to prevent or to minimize undesirable sidewise movement which might be transmitted to the plug. The bushing is provided near its inner end with cap securing structure, which may be an annular shoulder abutting the outside of the top cap. The two are attached to form a cap bushing to the cap with the two in secure abutting relationship. The bushing is of sufficient length also to receive at least a portion of the switch between the valve and its operating handle. It is constructed so that it may be used with or without the electrical switch without materially altering the appearance or use of the valve.

The valve-switch coupling means of the present invention includes coupling structures on the valve and switch that are engageable upon axial movement of the valve and switch toward each other so that they are firmly held in closely adjacent assembled relation. They are disengageable on movement with a fair amount of force in the reverse direction. In using the arrangement with the bushing, the latter is provided a short distance from the collar with radially outwardly and circumferentially extending coupling structure, which may take the form of a circumferentially extending bead or rib. It forms a first coupling structure of a two part detachable coupling means, the second coupling structure of which is formed as part of the switch and so as to be slidable axially to be closely adjacent or abut substantially flush against the outside of the top cap, where it is held against axial movement by the coupling means. Where the bushing is used, at least a part of the switch remains in driving relation to the stem so that the switch may be operated by rotation of the stem. The switch is held against angular movement by rotation of the stem by interengagement of top cap securing screws with apertures or recesses at the back of the switch. The coupling means is of a construction that is substantially unnoticeable should no switch be used, as is sometimes the case, and the switch can be readily uncoupled for removal, as for repairs. One of the coupling structures, preferably the one on the switch, includes a member of angularly disposed radially movable fingers or claws encircling the other coupling structure and engageable therewith when the switch and valve are pushed together into close assembled relation.

An object of this invention is the provision of a new and novel way of detachably, readily and firmly coupling a switch to a valve. The coupling means is confined within the axial length of the switch in the coupled position, and the switch itself is narrow or wafer-like. The fingers are so constructed that they can be sprung at one end, preferably their inner ends to allow snapping of their free ends over the coupling rib located adjacent the valve top cap to hold the switch in position. Another object is to provide a novel coupling structure on a switch having a plastic housing utilizing resilient fingers that can be molded in a plastic switch bottom plate without use of movable core pins. The fingers are designed with slight taper so that as bending movement increases, beam strength increases and strain is therefore more uniformly distributed over entire length as fingers are flexed.

The switch coupling structure provides only the minimal strength needed to keep switch in axial position on valve with a reasonable safety factor during shipping, assembly, and use. Operating and structural strength is provided by the interengagement or keying of recesses in the switch bottom with the top cap screw heads. This novel combination eliminates use of separate nuts, screws, pins, springs or cotters to hold switch on valve.

It also enables manufacture of a top cap and top cap bushing which are inexpensive and can be efficiently used with valves intended to be used with or without switches, and allows assembly of the switch, when used, without additional parts. Faster assembly is also made possible.

The above and other objects and advantages of the present invention will appear from the following detailed description of a preferred embodiment of the invention illustrated in the accompanying drawing, in which FIG. 1 is a top elevational view of the gas valve-switch of the present invention with the two parts being shown in coupled relationship, and with the valve handle shown in phantom;

FIG. 2 is an enlarged exploded perspective view of the assembly, with the switch uncoupled from the valve and the handle omitted;

FIG. 3 is a transverse slightly enlarged cross-sectional view taken along the line 3—3 of FIG. 1;

FIG. 4 is a fragmentary further enlarged axial cross-sectional view taken along the line 4—4 of FIG. 3; and FIG. 5 is an enlarged perspective view of a portion of the switch body coupling structure.

Referring to the drawing, and first to FIGS. 1 and 2, the gas valve-switch assembly of the invention is indicated by the reference character 10 as including a complete gas valve 12 and a complete electrical switch 14. The two are shown joined or coupled ready for use in FIG. 1 and uncoupled in FIG. 2. Coupling requires only axial movement of the two toward each other to the FIG. 1 position, wherein they are axially close to each other or in substantially flush abutting relation and uncoupling requires axial movement of them away from each other. When uncoupled, the complete unitary nature of each of the two components is readily evident from FIG. 2.

The illustrated gas valve is conventional in construction except for the coupling means indicated as a whole by reference character 16 comprising first and second coupling structures 16V and 16S on the valve and switch, respectively that are coupled by axial movement toward each other and uncoupled by movement apart from each other.

The gas valve conventionally comprises a body 20 having a gas inlet 22, and outlet 24, a flow controlling element such a rotor or plug 26 movable as from an off to full on position through a number of intermediate positions. The plug is mounted in a bore 28 in the body having forward enlargement 30 (FIG. 4), for a short forward plug extension 32, and a larger enlargement 34 for a centrally apertured plug drive washer 36 secured in suitable manner, peening for example, to the inner end of a plug rotating tubular stem 38. The latter projects through the switch when the switch is coupled to the valve and is flattened to provide a D-shaped driving portion, as shown at 39, for the attachment of a handle 40 at its outer end. The stem may be locked in conventional manner (not shown) in the off position of the valve and be axially movable inwardly to unlock the plug for rotation to its operative positions. The driving connection from the stem and drive washer 36 is through an axial tongue or finger 41 on the drive washer extending into an axial slot 42 at the periphery of plug extension 32. A conventional valve position indicating detent or click washer 44 is located to the inner side of the drive washer, toward which it is pressed by a conical spring 46, which also serves to maintain the plug 26 seated.

The front wall of the valve is constituted by a top cap 48 having a central aperture 49 and held in place by a pair of diagonally opposite machine screws 50 the heads 52 of which project outwardly and are utilized to prevent undesired angular movement of the switch.

Before describing the coupling means 16 of the present invention, the switch 14 will be described briefly. It, like the valve, may be of known construction except for changes to be described shortly accommodating it to the present invention. As illustrated, it comprises top and bottom (or outer and inner) housing or body portions 60 and 62 secured to each other as by diagonally opposite through rivets 64 (see FIG. 3). The top 60 is provided with an enlarged interior recess at 66 and the bottom is provided with a smaller opposed recess 68 rotatably to receive a switch contact operating cam 70 with a suitable peripheral cam surface defining lobe 72 or lobes for desired operation of electrical contact structure 74 (only partly shown in FIGS. 3 and 4) and having interior portions riding on cam surface 72. The contacts have terminals 74A and 74B extending outside the switch at opposite sides through opposed laterally projecting top and bottom projections 60A, 62A, 60B and 62B.

The cam 70 is centrally and circularly apertured at its inner end 76 for encirclement of valve stem 38 and a bushing 77 to be described shortly and forming part of coupling structure 16V. The centrally apertured portion 76 terminates in a relatively thin end wall 78 having flat 79 mating with the stem flat 39. The arrangement of the two flats provides the required axial sliding coupling and uncoupling movements and rotary driving connection of the switch and valve. The cam is rotatably journalled in the switch housing by oppositely extending circular supporting extensions 80 and 82 which ride in corresponding bearings 84 in the side wall of top 60 and 86 in the adjacent side of bottom 62.

The coupling 16 of the present invention enables the valve and switch firmly to be coupled and readily to be uncoupled by axial movement thereof in opposite directions. The coupling provides firm close axial relationship of the two, when assembled. At the same time, the stem is operatively connected to drive the cam.

The coupling 16V on the valve is illustrated as including the previously mentioned tubular bushing 77 attached to the top cap 48 at its central aperture 49 to project outwardly from the top cap to near the flat portion of the stem, but and is spaced from inner wall 76 of the cam (FIG. 4). The bushing thus has substantial axial length rotatably to receive the valve stem 38 with a close fit, thereby to prevent the stem from undesired sidewise movement with possible resultant misalignment of the plug and consequent leakage of gas. The single finger 41-slot 42 drive contributes to this feature as it prevents tipping of the plug as it is rotated. The bushing is provided with a radially outwardly and circumferentially extending attachment structure, such a shoulder or collar, 92 near its inner end, against which the outside of its top cap is abutted and held as by the peening 94.

In order to provide the close axial assembly without requiring any modification of the valve, the end wall of housing portion 62 facing the top plate is provided with cavities or recesses 96 for reception of the heads 52 of screws 50. This provides for interengagement of valve and switch to prevent undesired angular movement of the switch which might otherwise result from rotation of the cam by the valve stem, and cooperates in providing the close axial assembly.

The valve coupling structure 16V comprises circumferentially and radially extending structure such as the rib or bead 100 encircling at least portion of the exterior of the bushing 77 a short distance forwardly of the shoulder 92, this distance being sufficient to provide for effective retention of the switch on the valve by hereinafter described spring fingers on the switch when the two are brought together.

The switch coupling structure 16S of the embodiment illustrated in FIGS. 3–5, comprises generally tubular structure 101 encircling the bushing 77, when coupled, and includes axially and radially extending resilient fingers 102 movable with the switch toward the valve and resiliently to engage the exterior of the bushing 77 as the coupling is completed. The switch and its coupling structure are made of plastic and includes the circularly spaced spring fingers 102 (six being shown) substantially parallel and closely spaced to the exterior of the bushing 77. They have radially inwardly facing terminal claws 104 in what may be termed a recess 106 at the back of bottom part of 62, the fingers being constructed and arranged that the claws 104 can be forced on the valve structure thereby detachably to hold the switch in abutment with, or close to the valve. The inner ends of claws are slightly arcuate at their ends and chamfered at 105 as shown in FIG. 5 to facilitate coupling and uncoupling movement and gripping of the bushing.

To provide sufficient room for the necessary radial movement of the fingers, the recess 106 is made somewhat larger than the outside diameter circumscribed by the fingers. To provide for sufficient movement of and strength in the plastic fingers shown; the latter are relatively long and flexible so they can be sprung into place at their free ends. The fingers are designed with slight taper from their points of attachment to their free ends so that as bending movement increases, beam strength increases and strain is more uniformly distributed over entire length as the fingers are flexed. The design allows fingers to be molded in the plastic switch bottom without the use of core pins.

The fingers provide only minimal strength needed to keep switch in position on valve with a reasonable safety factor during shipping, assembly and use. Operating and structural strength is provided from the keying of the recesses in switch bottom with the top cap screw heads. This construction eliminates use of separate nuts, screws, pins springs or cotters to hold switch on valve. It also allows a top cap and top cap bushing which are less expensive, are common to valves to be used with or without switches, and allows assembly of the switch, when added, without additional parts. Assembly is also much faster than when other means are used.

What is claimed and desired to be secured by Letters Patent of the United States is:

1. A gas valve-electrical switch assembly comprising a gas valve including a body with an apertured end wall and a rotatable control element having a rotatable stem having a driving portion projecting through said wall, an electrical switch including a body, a rear wall positionable closely adjacent the body end wall and a contact operating cam rotatable by said driving portion of the stem when the body and switch walls are positioned, adjacent each other, said valve and switch assembly having structure of the quick connect-disconnect type including axially extending radially biased means on one engageable with the other releasably to hold the valve and switch firmly in said adjacent position and the switch operating cam drivingly engageable with the driving portion of the stem upon relative axial movement of the valve and switch toward said adjacent position and disengageable upon movement in the opposite direction.

2. Apparatus as claimed in claim 1 wherein said radially biased means includes a tubular stem encircling portion having angularly spaced apart axially extending spring fingers.

3. An electrical switch as claimed in claim 2 wherein said spring fingers have an axial length no greater than width of the switch.

4. An electrical switch as claimed in claim 2 wherein said fingers have free terminal portions with radially inwardly extending claws.

5. An electrical switch as claimed in claim 2 wherein the switch includes front and rear housing parts, the fingers are in the rear part and extend from the interior rearwardly to near the rear wall.

6. An electrical switch as claimed in claim 2 wherein the cam is located forwardly of the axially extending radially biased means of the switch.

7. A gas valve-electrical switch assembly comprising a gas valve including a body with an apertured front wall, a movable flow control element and a rotatable stem operatively connected to said element including a driving portion projecting through said wall, and an electrical switch including a body having a back wall movable with the switch to an assembled position with its back wall closely adjacent the front wall of the body and having also a switch operating element rotatable by said driving portion of the stem in said assembled position, said valve and switch having quick attach-detach coupling means comprising coupling structures associated therewith engageable with each other releasably to retain the valve and switch in assembled relation and to provide driving engagement between said driving portion of the stem and said switch operating element upon relative axial movement of the valve and switch in one direction into said position, said coupling structures being disengageable upon relative movement of the switch and valve in the opposite direction.

8. An electrical switch for releasable retention in a position closely adjacent the front end of a gas valve having structure including an operating stem rotatable about an axis and with a forward driving portion, characterized in that said switch is apertured for movement in one direction axially of the stem to said position and in the opposite direction for removal from said position, said switch including axially extending quick attach-detach structure resiliently engageable with said valve structure for releasably and firmly retaining said switch axially in said position upon movement into said position, and including also switch contact operating means engageable with said driving portion of said stem when in said position.

9. An electrical switch for releasable axial attachment to a gas valve having switch retention structure and a rotatable gas flow controlling axially extending drive stem, characterized in that said, switch includes switch retaining and driving means of the quick attach-detach type encircling and axially movable relative to the stem and retention structure, said driving means being movable with said switch toward the valve and its retention structure detachably to retain the switch in assembled relation to the valve and to connect the driving means to the stem upon axial movement in one direction and to do the reverse upon axial movement in the opposite direction.

10. An electrical switch for attachment to a gas valve having a stem with a rotatable portion projecting through a cap attached to the front end of the valve by cap screws projecting forward of the valve and having also first coupling structure at its front end attachable with second coupling structure upon axial movement of said structures toward each other, characterized in that said switch comprises a two part housing of insulating material, movable electrical contacts in said housing, a contact operating cam mounted for rotation in said housing parts, a rear part of the switch housing being locatable in a position closely adjacent the cap and having recesses for reception of the projecting portions of the cap screws, thereby to prevent angular movement of said switch housing in said position, said switch also including second coupling structure of the quick attach-detach type adapted to be coupled to the first coupling structure and the contact operating cam being adapted to be drivingly to be coupled to said rotatable portion of the stem when the switch is located in said position.

11. An electrical switch as claimed in claim 10 wherein the contact operating cam is located forward of the switch second coupling structure.

12. An electrical switch for attachment to a gas valve having a stem with a rotable portion projecting through the front of the valve and having projecting headed cap screws and first coupling structure at the front of the valve engageable with other coupling structure upon axial movement of said structures toward each other into an adjacent position and detachable on reverse axial movement, characterized in that said switch includes a housing of insulating material, movable electrical contacts in said housing, a contact operating cam rotatable in said housing, the rear portion of the switch housing being locatable adjacent the front of the valve and having recesses for reception of the projecting portions of the cap screws to prevent angular movement of said switch housing, and said switch includes second coupling structure of the quick attach-detach type adapted relatively tightly to be axially coupled in said adjacent position to the coupling structure at the front of the valve against reverse uncoupling movement, and contact operating means adapted to be drivingly coupled to said rotatable portion of the stem where the switch and valve are in said adjacent position.

13. An electrical switch as claimed in claim 12 wherein the first coupling structure is constituted by an axially extending tubular bushing with a circumferentially extending bead or collar having a part facing the valve, and said switch is further characterized in that said second coupling structure includes an apertured portion slidable on the bushing, said portion including a number of axially extending spring fingers movable over said bead to engage with the part of bead facing the valve.

14. An electrical switch as claimed in claim 13 wherein said spring fingers have downwardly extending claws at their free ends and are tapered in thickness toward the claws.

* * * * *